United States Patent [19]

Sassi

[11] 4,090,445

[45] May 23, 1978

[54] FABRIC PRINTING MACHINE WITH IMPRESSION CYLINDER WASHING

[75] Inventor: Enzo Sassi, Sesto San Giovanni (Milan), Italy

[73] Assignee: Crompton & Knowles Corporation, New York, N.Y.

[21] Appl. No.: 740,647

[22] Filed: Nov. 10, 1976

Related U.S. Application Data

[63] Continuation-in-part of Ser. No. 522,969, Nov. 11, 1974, abandoned.

[30] Foreign Application Priority Data

Aug. 9, 1974 Italy ..... 26193 A/74

[51] Int. Cl.[2] ..... B41F 35/00

[52] U.S. Cl. ..... 101/425; 101/178; 101/219; 15/256.52; 118/70; 118/203

[58] Field of Search .....118/70, 203; 15/256.52; 101/423–425, 178, 183, 220–223, 225, 219, 181, 180

[56] References Cited

U.S. PATENT DOCUMENTS

| | | | |
|---|---|---|---|
| 2,264,475 | 12/1941 | Learnard | 101/178 |
| 2,659,305 | 11/1953 | Giori | 101/423 |
| 3,120,805 | 2/1964 | Simon | 15/256.52 |
| 3,389,656 | 6/1968 | Giori | 101/424 |
| 3,871,081 | 3/1975 | Inone et al. | 101/425 |
| 4,015,307 | 4/1977 | Kossak | 101/425 |

FOREIGN PATENT DOCUMENTS

| | | | |
|---|---|---|---|
| 249,342 | 6/1947 | Switzerland | 101/423 |
| 796 of | 1897 | United Kingdom | 101/423 |

*Primary Examiner*—William Pieprz
*Attorney, Agent, or Firm*—Howard G. Garner

[57] ABSTRACT

A printing machine for fabrics which comprises a drum rotatably supported with its axis along a horizontal plane on which the printing operations are carried out. This drum is associated with a multiplicity of printing rollers arranged along the descending portion of approximately 180° of its cylindrical surface and with means for cleaning the drum surface itself which has been contaminated during the printing operations arranged along the ascending portion of the surface.

8 Claims, 3 Drawing Figures

24
34
33
26
28
25
27
29
17
18
30
31
19

FABRIC PRINTING MACHINE WITH IMPRESSION CYLINDER WASHING

This application is a continuation-in-part of my application Ser. No. 522,969, filed Nov. 11, 1974, and now abandoned.

BACKGROUND OF THE INVENTION

This invention relates to a printing machine specially intended for use with textile materials, laminated plastics, synthetic leather, and the like.

It is well known that the available printing machines for textile materials comprise essentially a drum, whereabout there are arranged, along a major portion of its cylindrical surface, printing rollers which separately print patterns or the like onto a web which surrounds the drum. Such printing machines feature basically a loop configurated mat, surrounding the drum, which is interposed between the web and the drum. Said mat, however, is much longer than the drum circumference and is taken up and kept under tension by a plurality of suitable devices placed outside the drum. This mat acts as a back up member for the web during the printing operation, i.e. it is effective in providing a flat and continuously clean surface whereagainst the printing rollers bear in operational engagement with said cylinder.

Such printing machines, as are well known in the art, present some notable drawbacks. Firstly, their adjustment involves valuable time, while their maintenance is fairly complex. Their maintenance costs are high because the mat requires periodical adaptation, obviously to be carried out at a separate location, and the complexity of the machinery involves considerable down time, which in turn aggravates the production costs. It should be noted, moreover, that said mat has a length in the order of dozens of meters, thereby requiring the use of equipment of sizeable dimensions, which tends to discourage the adoption of these machines by small enterprises with limited space facilities. Lastly, a major disadvantage resides in the fact that the mat, whereupon the printing rollers bear during operation, being of large size, is not perfectly flat and uniformly thick, therefor requiring considerable pressure by the printing rollers, which in turn causes premature wear and difficulties in providing on the textile material being printed the desired shade and fading effects.

In view of the above, the applicant saw that there exists a need for a more rationally designed and constructed printing machine which obviates the problems and drawbacks typical of the printing machines employed heretofore, and makes it possible to both improve on the quality of the printed textile material, or the like, and to reduce the cost of said printed material.

SUMMARY OF THE INVENTION

A major object of this invention is accordingly to solve the technical problem of providing a printing machine which ensures low initial and running cost levels, easy maintenance, reduced size, and first and foremost a very accurate printing action.

It is another object of this invention to provide a printing machine which is at one time of robust and straightforward construction, so that it may be easily manufactured by the industries of this field.

These and other objects still, such as will become apparent hereinafter, are achieved by a printing machine according to the invention, comprising a fixed supporting structure, a rotating cylindrical drum supported by said structure, said drum having a horizontal axis of rotation and a periphery having a lowermost and an uppermost point with respect to said axis of rotation, a coating of rubber material tightly wound over and attached to the whole peripheral surface of said drum, a plurality of printing and guiding rollers supported by said structure and located close to the periphery of said drum so as to print and guide respectively a web wound over a portion of said drum periphery and said coating from a point of engagement close to said uppermost point to a point of disengagement close to said lowermost point, and a washing apparatus and a drying assembly for said coating facing an opposite portion of said drum periphery which is not covered by said web, said washing apparatus being located in close proximity to said lowermost point of the drum periphery and including rotating brushes cooperating with said rubber coating, spraying members for directing jets of washing liquid towards the rubber coating through said rotating brushes, a receptacle arranged below said brushes and said spraying members for collecting the washing liquid when leaving the rubber coating, at least one barrier member arranged at an inlet end of the washing apparatus closer to the lowermost point of the drum periphery to prevent the washing liquid from descending along said drum periphery towards said lowermost point and at least one squeegee member arranged at an outlet end of the washing apparatus farther from the lowermost point of the drum periphery to prevent the rubber coating from emerging from the washing apparatus as covered by a film of washing liquid.

The printing machine according to the invention achieves its objects in that, thanks to the removal of the mat used in the prior art machines and to the provision for printing directly over a rubber coating of a central drum, the printing machine is greatly simplified and made more efficient, offering much more advantageous application conditions. The printing machine according to the invention is in fact easy to adjust for operation, has low initial and running costs, since less power is required to operate its components, and a low maintenance cost, since it is less liable to accidental failure and down time and especially because it can be refaced in situ periodically, without requiring special facilities outside of the production area, as it was required by the prior art machines. All this results in a lower cost of the textile material per yard, substantially lower than that of the materials produced with the known machines. Another advantage of the invention comes from the fact that the instant machine has a much reduced size with respect to the prior art ones, and may thus be accomodated in limited spaces.

However, the main advantage offered by the printing machine according to the invention resides in the fact that a much higher quality level is achieved in printing than it was possible heretofore. This is so thanks to the fact that the printing rollers work against a surface, i.e. the cylindrical surface of the central drum, which is rubber lined and can thus be made perfectly smooth and refaced. The rubber mat employed in the prior art, even when it is subjected to treatment directed to maintain its thickness as uniform as possible, can never have a perfectly uniform thickness of high precision, such as can be obtained in the case of a drum through a refacing operation. With the printing machine according to the invention it becomes possible, on the contrary, to produce very accurate shade and fading effects, and to operate with printing rollers which exert a much reduced pressure on the drum, thereby reducing the machine rate of wear.

In any case, it should be noted that considerable importance is to be attached to the disposition and structural features of the washing apparatus, which, in combination with the drying assembly, has the basic function of providing perfect cleaning of the rubber coating of the drum between one printing operation and the next one. As will promptly be understood, in fact, only a specially designed washing apparatus allows the advantageous substitution of a simple rubber coating as according to the present invention for the convention long mat of the prior art printing machines.

As will better be explained later, a first essential feature of the washing apparatus of the printing machine according to the invention consists in that said washing apparatus is located very close to the lowermost point of the drum, that is to the point of disengagement of the web from the drum. This disposition of the washing apparatus, on one hand, allows the washing liquid to act on the printing paste before the latter dries up and, on the other hand, leaves maximum space for the drying assembly.

Another essential feature of said washing apparatus is then represented by the particular disposition of the spraying members, which are arranged in such a manner as to direct jets of washing liquid towards the brushes rather than directly towards the rubber coating of the drum. This disposition, in fact, allows the brushes to be washed while washing the rubber coating, so that the brushes are maintained in perfect washing conditions for long time, as necessary.

Condition printing machine according to the invention are represented by the barrier and squeegee members arranged at the inlet and outlet ends of the washing apparatus. They limit, the action of the washing liquid to a restricted area, preventing said liquid towards the lowermost point of the drum and then dropping onto the web and remaining on the washed coating as a film which cannot be removed by the drying assembly.

A preferred feature of said washing apparatus is finally represented by deflecting wall members arranged downstream of each brush of the washing apparatus in the direction of rotation of the drum. Said wall members have the main purpose of conveying the jets of washing liquid towards the rubber coating of the drum, so that dispersion and nebulization of the washing liquid are avoided, as well as that of conveying the dirty washing liquid leaving the rubber coating towards a suitable collecting vat. Moreover, said wall members allow the brushes to operate in separate chambers with different rates of dirt, thus avoiding transferring of dirt from the lower, dirtier, chamber to the upper, less dirty, chamber.

BRIEF DESCRIPTION OF THE DRAWINGS

Other features and advantages of the invention will be more apparent from the following description of one preferred embodiment thereof, illustrated by way of example but not limitatively in the attached drawings, wherein.

DESCRIPTION OF THE PREFERRED EMBODIMENT

Figure 1:
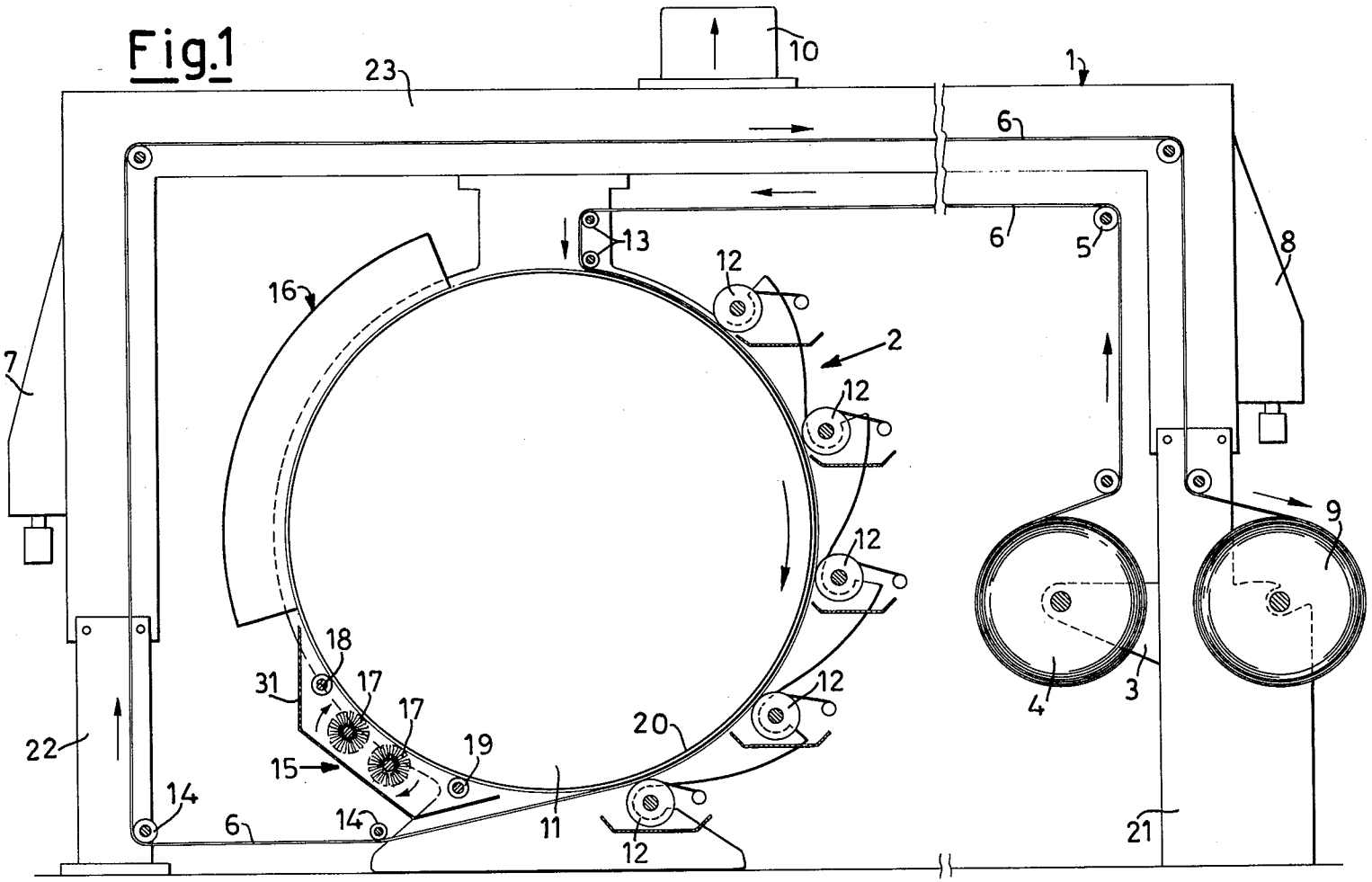
FIG. 1 schematically shows a side elevation view of a preferred embodiment of the printing machine according to the invention.

The printing machine shown in the drawings comprises an outer portal-like supporting structure 1, having two end vertical legs 21 and 22 and an upper horizontal cross-member 23, and an inner printing assembly 2 (FIG. 1).

The supporting structure 1 is provided with brackets 3 extending from the end leg 21 for rotatably supporting a web issuing spool 4, from which a web 6 unwinds towards the printing assembly 2. Tensioning and guide rollers 5 and 13 cause the web 6 to follow the end leg 21 and then the cross-member 23 while going from the spool 4 to the printing assembly 2. Guide rollers 14 cause in turn the web 6 to follow the end leg 22, then the cross-member 23 and finally the end leg 21 while going from the printing assembly 2 to a web receiving spool 9 rotatably supported by the leg 21. Two web driers 7 and 8 are associated to the end legs 22 and 21 to dry the web 6 emerging from the printing assembly 2. The air blown over the web 6 by the driers 7 and 8 is discharged to the atmosphere through an exhauster 10 mounted on the upper cross-member 23 of the supporting structure 1.

The printing assembly 2 comprises essentially a rotating cylindrical drum 11, around the whole periphery of which a rubber coating 20 is tightly wound and attached. As shown in FIG. 1, the web 6 is led over a portion of the cylindrical periphery of the drum 11 between the rubber coating 20 and a succession of printing rollers 12, which receive suitable printing pressure by hydraulic devices of known type. Each printing roller 12 operates independently from the adjacent printing roller and is spaced apart therefrom a distance adequate to prevent contamination.

It may be observed from FIG. 1 that the web 6 is wound over a limited portion of the cylindrical surface of the drum 11, which portion does not comprise the lower pole or lowermost point thereof. This portion is such that in its peripheral arc defines an angle at the center of the drum smaller than 180°. It is also provided that the point of engagement of the web 6 with the drum 11 is close to the upper pole or uppermost point of the same drum, while the disengagement point is close to the lower pole or lowermost point.

As a consequence, there remains an opposite portion of the cylindrical surface of the drum 11, which is not engaged by the web 6. Along this portion, the extension of which is approximately equal to that of the portion engaged by the web 6, there are arranged a washing apparatus 15 and a drying assembly 16, which are mounted sequentially in the direction of rotation of the drum 11. It may be observed from FIG. 1 that the washing apparatus 15 and the drying assembly 16 are dimensioned so as to take advantage of almost entirely the portion of cylindrical surface of the drum 11 not engaged by the web. They occupy in actual fact a portion of the surface of the drum 11 similar to that engaged by the web 6.

Figure 2:
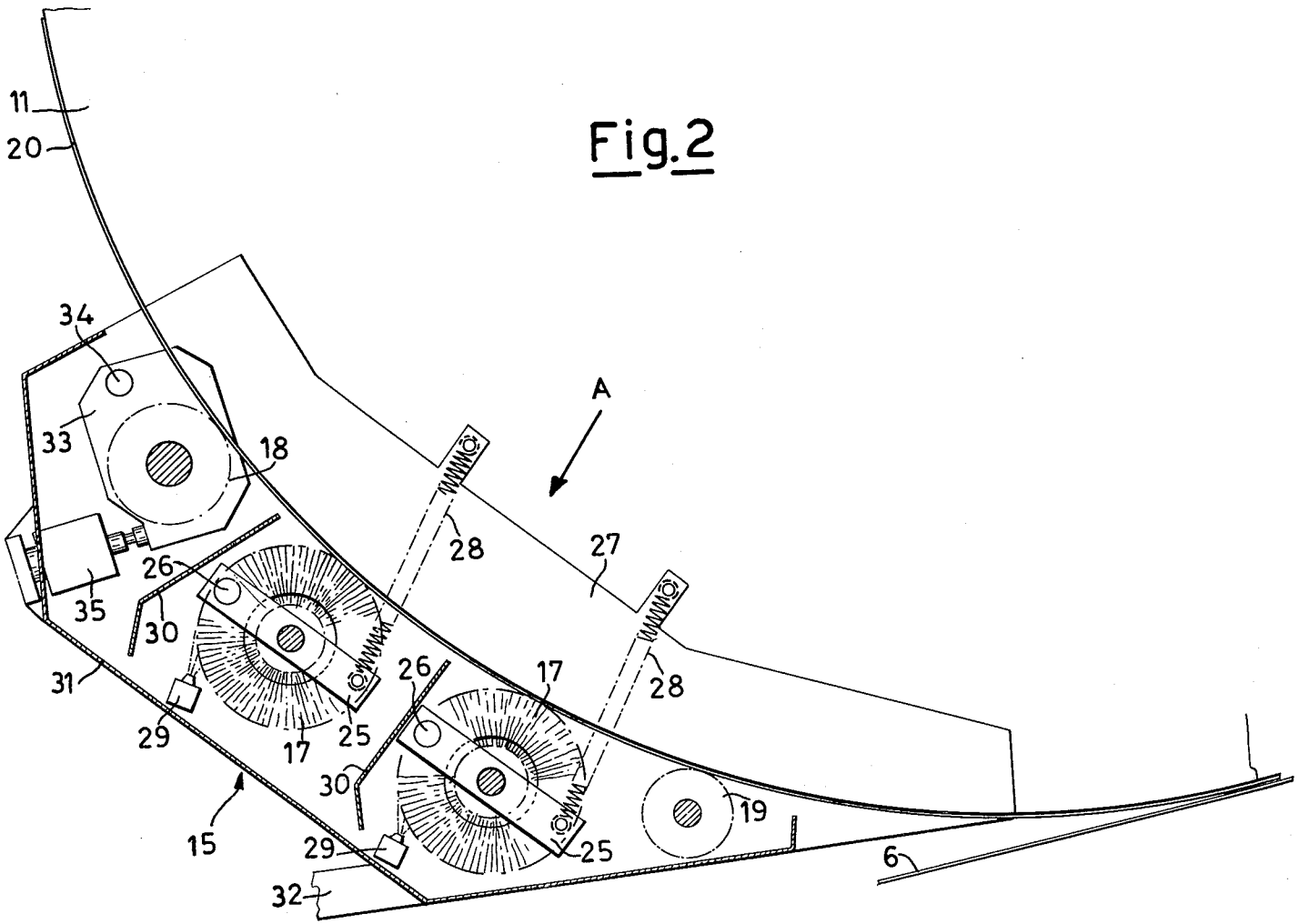
FIG. 2 shows an enlarged and detailed sectional view of the washing apparatus comprised in the printing machine shown in FIG. 1.
Figure 3:
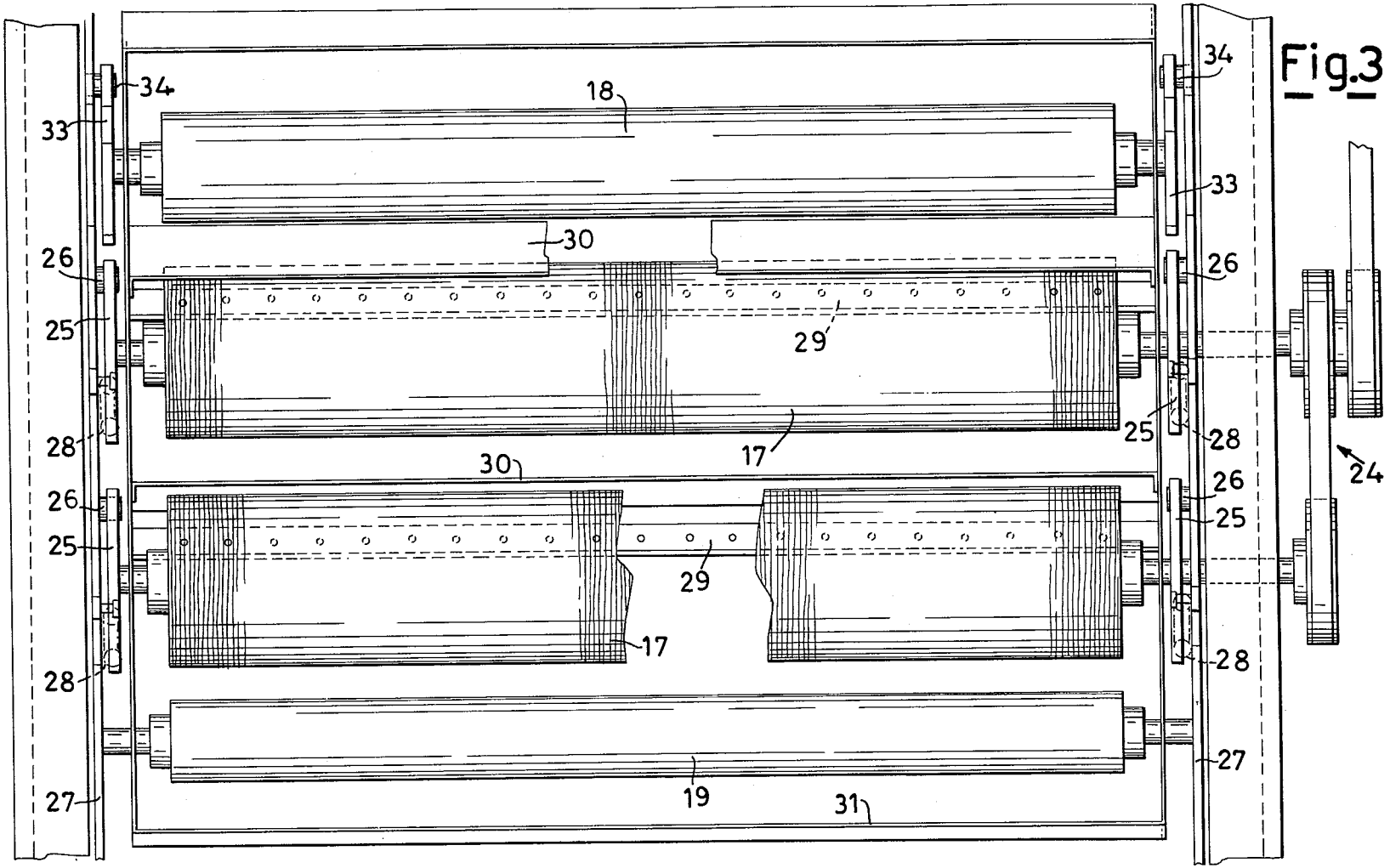
FIG. 3 shows said washing apparatus as viewed from A in FIG. 2.

The washing apparatus 15 is provided with suitable means to allow the rubber coating of the drum 11 to be efficiently washed, and then dried by the drying assembly 16, after each disengagement from the web 6 and before being further engaged by a following portion of the same web. As shown in details in FIGS. 2 and 3, the washing apparatus 15 comprises two rotating brushes 17, which are driven to rotate by suitable driving means (not shown in the drawings) through a pulley-belt transmission system 24 (FIG. 3). Said brushes are rotatably supported by end plates 25 pivoted at 26 on fixed sidewalls 27 and are drawn in engagement with the drum 11 and the superimposed rubber coating 20 by respective springs 28 reacting between the plates 25 and the sidewalls 27 (FIG. 2). To the rotating brushes 17 there are associated respective spraying members 29, which are located behind the brushes 17 (FIG. 2) so as to be able to direct jets of washing liquid (water, for example) onto the brushes 17, which then convey the same onto the rubber coating 20, rather than directly onto the rubber coating; this allows the brushes 17 to be washed while washing the rubber coating of the drum 11 in order to maintain the brushes in perfect washing condition.

Deflecting wall members 30 are arranged downstream of each brush 17 in the direction of rotation of the drum 11 and cooperate with the brushes 17 to convey the jets of washing liquid towards the rubber coating of the drum 11, thus avoiding dispersion and nebulization of the washing liquid. They have also the function of conveying the dirty washing liquid leaving the rubber coating towards a box-like collecting container or vat 31 (FIG. 2), which is located below the brushes 17 and the spraying members 29 and is provided with a discharging duct 32. Finally, the wall members 30 allow the brushes 17 to operate in distinct chambers with different rates of dirt, thus avoiding transferring of dirt from the lower, dirtier, chamber to the upper, less dirty, chamber.

At an inlet end of the washing apparatus 15, there is provided a barrier roller 19, which is supported by the sidewalls 27 in such a position, with respect to the drum 11, as to be able to prevent the washing liquid from descending along the drum periphery towards the lowermost point of the drum 11 and then onto the web 6. At an outlet end of the washing apparatus 15, there is in turn provided a squeegee roller 18, which is rotatably supported by end plates 33 pivoted at 34 on the sidewalls 27 and is pushed by a hydraulic cylinder 35 (FIG. 2) against the drum 11 with such a pressure as to prevent the rubber coating 20 from emerging from the washing apparatus 15 as covered by a film of washing liquid. The latter is an imperative condition to allow the drying assembly 16 to efficiently dry the rubber coating before the latter is engaged by the web 6 once more.

It should be noted from FIG. 1 that the washing apparatus 15 is located in close proximity to the point of disengagement of the web 6 from the drum 11, and moreover close to the lower pole of the drum itself. This is also an imperative condition for the washing apparatus, since it allows the washing liquid to act on the printing paste before the latter dries up. A more efficient washing operation is thus made possible. Moreover, maximum space is left to the drying assembly 16.

As regards the drying assembly 16, conventional blowing means are provided therein to blow hot air upon the damp surface of the rubber coating of the drum 11 until said coating is completely dry to an extent suitable for a fresh printing operation.

From the above detailed description, the operation of the printing machine according to the instant invention may be appreciated. The web 6 is tensioned and made to adhere, through the guide rollers 13, directly onto the rubber coating of the central drum 11, without resorting to other auxiliary means. It is thus the cylindrical surface of the central drum 11, particularly its rubber coating 20, which defines, in bearing engagement with the printing rollers 12, the degree of accuracy of the printing action. Since the printing pastes applied by the printing rollers 12 usually penetrate the web 6 contaminating the rubber coating of the drum 11, according to the instant invention the same rubber coating is washed clean and dried by the washing apparatus 15 and drier 16, respectively, such as to offer to the rollers 12 a surface which is at all times clean and dry.

As explained above, the washing apparatus 15 is able to efficiently wash the rubber coating 20 and to put the same in suitable conditions to be dried by the drying assembly 16. This is due, on one hand, to the disposition of the washing apparatus very close to the point of disengagement of the web 6 from the drum 11 and, on the other hand, to the special construction of the washing apparatus, particularly to the arrangement of the spraying members so as to direct jets of washing liquid towards the brushes and to the provision of barrier and squeegee members at the ends of the washing apparatus. The above mentioned disposition allows in fact the washing liquid to act on the printing paste before the latter dries up, while the above mentioned construction allows the rotating brushes to be continuously washed together with the rubber coating of the drum, and prevents the washing liquid from descending towards the web and prevents the washed rubber coating from emerging from the washing apparatus covered by a film of washing liquid (which would not allow the drying assembly 16 to sufficiently dry the rubber coating). In conclusion, the rubber coating is thus caused to emerge from the washing apparatus 15 and the drying assembly 16 in perfectly washed and dried conditions in view of its subsequent reengagement by the web for a fresh printing operation.

It should be noted that the embodiment of the invention described above is susceptible to many variations and modifications falling within the inventive idea as defined in the following claims.

Furthermore, all the details disclosed may be replaced with equivalent ones.

In practicing the invention, the materials used and the dimensions may be any ones, to suit varying application conditions.

What I claim is:

1. A printing machine for printing fabrics or other porous materials comprising:

(a) a fixed supporting structure;

(b) a rotating cylindrical drum supported by said structure, said drum having a horizontal axis of rotation, the periphery of said drum having a descending half and an ascending half;

(c) a coating of rubber material attached to said drum periphery;

(d) upper and lower guide rollers for guiding an advancing web into and out of contact with said rubber coating on the descending half of the drum over an arc which is not greater than 180° and which excludes the lowermost point of said drum periphery;

(e) a plurality of printing rollers supported by said structure for printing said web at spaced points while it is in contact with said coating of periphery;

(f) means disposed along the ascending half of said drum periphery coating for washing and coating said ascending half with a liquid;

(g) at least one barrier member supported by said fixed structure and located between said washing means and the lowermost point of said drum for engaging said coating of rubber material and preventing washing liquid from descending along said coating toward said lowermost point;

(h) at least one squeegee member supported by fixed structure and located above said washing means on the ascending half of said periphery drum for engaging said coating and preventing said rubber coating from having a film of cleaning liquid after it ascends from said squeegee member; and (i) a receptacle located beneath said squeegee member, said washing means and said barrier member for collecting washing liquid therefrom.

2. A printing machine as set forth in claim 1 wherein said washing means comprises:

(a) rotating brushes for scrubbing said rubber coating; and (b) spraying members for directing jets of washing liquid towards said rubber coating through said rotating brushes.

3. A printing machine according to claim 1 wherein said washing means further includes deflecting wall members cooperating with said brushes to convey the jets of washing liquid towards the rubber coating of the drum and to convey washing liquid leaving the rubber coating towards said receptacle.

4. A printing machine as set forth in claim 1 wherein said web engages said rubber coating from a point substantially at the uppermost point of said drum to a point close to said lowermost point.

5. A printing machine as set forth in claim 1 wherein said upper guide roller is located above the uppermost point of said drum periphery and said lower guide roll is located beneath the lowermost point of said drum periphery for guiding said web beneath said receptacle.

6. A printing machine for printing fabrics or other porous materials comprising:

(a) a fixed supporting structure;

(b) a rotating cylindrical drum supported by said structure, said drum having a horizontal axis of rotation, the periphery of said drum having a descending half and an ascending half;

(c) a coating of rubber material attached to said drum periphery;

(d) upper and lower guide rollers for guiding an advancing web of fabric or other porous material into and out of contact with said rubber coating on the descending half of the drum along an arc no greater than 180° which excludes the lowermost point on the periphery of said drum;

(e) a plurality of printing rollers supported by said structure for printing said web at spaced points while it is in contact with said drum periphery;

(f) washing means located adjacent the lower portion of the ascending half of said drum periphery for washing residual printing material from said coating and including rotating brushes for scrubbing said rubber coating and spraying members for directing jets of washing liquid towards said rubber coating through said rotating brushes;

(g) at least one barrier member supported by said fixed structure and located between said washing means and the lowermost point of said drum for engaging said coating of rubber material and preventing washing liquid from descending along said coating towards said lowermost point; and (h) at least one squeegee member supported by said fixed structure and located above said washing means on the ascending half of said drum for engaging said coating and preventing said rubber from having a film of cleaning liquid after it ascends from said squeegee member.

7. A printing machine as set forth in claim 6 comprising a receptacle located beneath said squeegee member, said washing means and said barrier member for collecting washing liquid therefrom.

8. A printing machine as set forth in claim 7 wherein said upper guide roller is located above the uppermost point of said drum periphery and said lower guide roll is located beneath the lowermost point of said drum periphery for guiding said web beneath said receptacle.

* * * * *